US007290399B2

(12) United States Patent
Taras et al.

(10) Patent No.: US 7,290,399 B2
(45) Date of Patent: Nov. 6, 2007

(54) MULTI-CIRCUIT DEHUMIDIFICATION HEAT PUMP SYSTEM

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 222 days.

(21) Appl. No.: 10/942,695

(22) Filed: Sep. 16, 2004

(65) Prior Publication Data

US 2006/0053822 A1 Mar. 16, 2006

(51) Int. Cl.
*F25D 17/06* (2006.01)
*F25B 13/00* (2006.01)

(52) U.S. Cl. ..... 62/159; 62/93; 62/324.1

(58) Field of Classification Search ..... 62/324.1, 62/324.6, 159, 196.4, 90, 92, 93
See application file for complete search history.

(56) References Cited

U.S. PATENT DOCUMENTS

| | | | | |
|---|---|---|---|---|
| 3,264,840 | A | 8/1966 | Harnish | |
| 4,876,859 | A | 10/1989 | Kitamoto | |
| 5,094,085 | A | 3/1992 | Irino | |
| 5,095,712 | A | 3/1992 | Narreau | |
| 5,157,933 | A | 10/1992 | Brendel | |
| 5,622,057 | A * | 4/1997 | Bussjager et al. | 62/173 |
| 5,752,389 | A * | 5/1998 | Harper | 62/176.5 |
| 5,875,637 | A | 3/1999 | Paetow | |
| 5,953,926 | A * | 9/1999 | Dressler et al. | 62/175 |
| 6,055,818 | A | 5/2000 | Valle | |
| 6,206,652 | B1 | 3/2001 | Caillat | |
| 6,276,148 | B1 | 8/2001 | Shaw | |
| 6,381,970 | B1 | 5/2002 | Eber | |
| 6,422,308 | B1 | 7/2002 | Okawara | |
| 6,427,461 | B1 | 8/2002 | Whinery | |
| 6,595,012 | B2 | 7/2003 | Rafalovich | |
| 6,644,049 | B2 * | 11/2003 | Alford | 62/90 |
| 6,701,723 | B1 | 3/2004 | Dobmeier | |
| 6,705,093 | B1 * | 3/2004 | Taras et al. | 62/90 |
| 6,941,770 | B1 | 9/2005 | Taras | |
| 2003/0136140 | A1 | 7/2003 | Maeda | |
| 2006/0053820 | A1 * | 3/2006 | Taras et al. | 62/324.1 |
| 2006/0053821 | A1 * | 3/2006 | Taras et al. | 62/324.1 |
| 2006/0053823 | A1 * | 3/2006 | Taras et al. | 62/324.1 |

FOREIGN PATENT DOCUMENTS

JP 56051963 A * 5/1981

* cited by examiner

*Primary Examiner*—Chen-Wen Jiang
(74) *Attorney, Agent, or Firm*—Carlson, Gaskey & Olds

(57) ABSTRACT

In a multi-circuit heat pump system least one of the circuits has a reheat function. Various reheat concepts may be independently utilized for each circuit to reheat and dehumidify air. Moreover, the ability to bypass refrigerant around the outdoor heat exchanger may also be provided. Communication means between the circuits may be present to re-optimize the refrigerant charge and to provide better control over system operational parameters. The above mentioned control functions and design features assure system flexibility in satisfying a wide spectrum of market requirements and potential applications by operation in a variety of cooling, heating and dehumidification regimes and a combination of thereof.

21 Claims, 2 Drawing Sheets

MULTI-CIRCUIT DEHUMIDIFICATION HEAT PUMP SYSTEM

BACKGROUND OF THE INVENTION

This application relates to multi-circuit heat pump systems that are capable of operating in both cooling and heating modes. Further, these systems are provided with the circuits that have the ability to independently operate in various regimes in order to satisfy a wide spectrum of sensible and latent capacity demands. Typically, these systems have a reheat coil(s), incorporated into the system design to provide a reheat function, and additional control means capable of alternating between operational regimes independently for each circuit in response to environmental conditions and load demands.

Refrigerant systems are utilized to control the temperature and humidity of air in various environments to be conditioned. One type of a refrigerant system is a heat pump that can operate in a cooling mode or heating mode. Typically, in a cooling mode, a refrigerant is compressed in a compressor and delivered to an outdoor heat exchanger. In the outdoor heat exchanger, heat is exchanged between outside ambient air and the refrigerant. From the outdoor heat exchanger, the refrigerant passes to an expansion device in which the refrigerant is expanded to a lower pressure and temperature, and then to an indoor heat exchanger. In the indoor heat exchanger, heat is exchanged between the refrigerant and the indoor air, to condition the indoor air. When the cooling mode is in operation, an indoor heat exchanger cools the air that is being supplied to the indoor environment. In addition, as the temperature of the indoor air is lowered, moisture usually is also taken out of the air. In this manner, the humidity level of the indoor air can also be controlled.

In the heating mode, the refrigerant flow through the system is essentially reversed. The indoor heat exchanger becomes the condenser and releases heat into the environment to be conditioned (heated in this case) and the outdoor heat exchanger becomes the evaporator and exchanges heat with a relatively cold outdoor air. Heat pumps are known as the systems that can reverse the refrigerant flow through the refrigerant cycle in order to operate in both heating and cooling modes. This is usually achieved by incorporating a four-way valve or an equivalent device into the system schematic downstream of the compressor discharge port. The four-way valve selectively directs the discharge refrigerant flow through the indoor or outdoor heat exchanger when the system is in the heating or cooling mode of operation respectively. Furthermore, if the expansion device is not capable of handling the reversing flow, then, for example, a pair of unidirectional expansion devices, each along with the corresponding check valve, is to be employed instead.

In some cases, the temperature level, to which the air is brought to provide comfort environment in the conditioned space, may need to be higher than the temperature that would provide the ideal humidity level. Such corresponding levels of temperature and humidity may vary from one application to another and are highly dependent on environmental and operating conditions. This has presented design challenges to refrigerant cycle designers. One way to address such challenges is to utilize reheat coils. In many cases, the reheat coils, placed in the path of the indoor air stream behind the indoor heat exchanger, are employed for the purpose of reheating the air supplied to the conditioned space after it has been overcooled in the indoor heat exchanger for moisture removal.

Multi-circuit refrigerant systems are also applied in the industry, wherein several independent circuits operate under a single control to provide various levels of sensible and latent capacity in response to the external load demands and wherein each circuit can independently function in one of several operational regimes.

A further option available to a refrigerant system designer is to integrate a reheat coil(s) in the schematics for at least one of the refrigerant circuits of a multi-circuit system. As mentioned above, in a reheat coil, at least a portion of the refrigerant upstream of the expansion device is passed through a reheat heat exchanger and then is returned back to the main circuit, and at least a portion of the conditioned air having passed over the indoor heat exchanger is then passed over this reheat heat exchanger to be reheated to a desired temperature.

However, multi-circuit heat pump systems have not been provided with the reheat function.

SUMMARY OF THE INVENTION

In disclosed embodiments of this invention, a multi-circuit heat pump system incorporates at least two circuits, and at least one of those circuits has a reheat coil in a reheat branch of the circuit. The provision of the reheat coil allows dehumidification to a greater extent than would otherwise be dictated by achieving a desired temperature level.

These multiple circuits can be inter-related in some manner, such that they can interact or communicate refrigerant between the circuits in response to environmental conditions, unit operating parameters, external sensible and latent load demands, and the mode of operation of each circuit.

In further features, the heat pump could be provided with the ability to bypass refrigerant around at least one of the outdoor heat exchangers. This function can be integrated into the control for the reheat branch operation.

It should be noted that this invention is not referenced to any particular reheat concept but rather provides advantages for any heat pump system designed for dehumidification, cooling and heating through the integrated reheat function, interaction between the circuits and enhanced control logic.

These and other features of the present invention can be best understood from the following specification and drawings, the following of which is a brief description.

DETAILED DESCRIPTION OF THE PREFERRED EMBODIMENT

Figure 1:
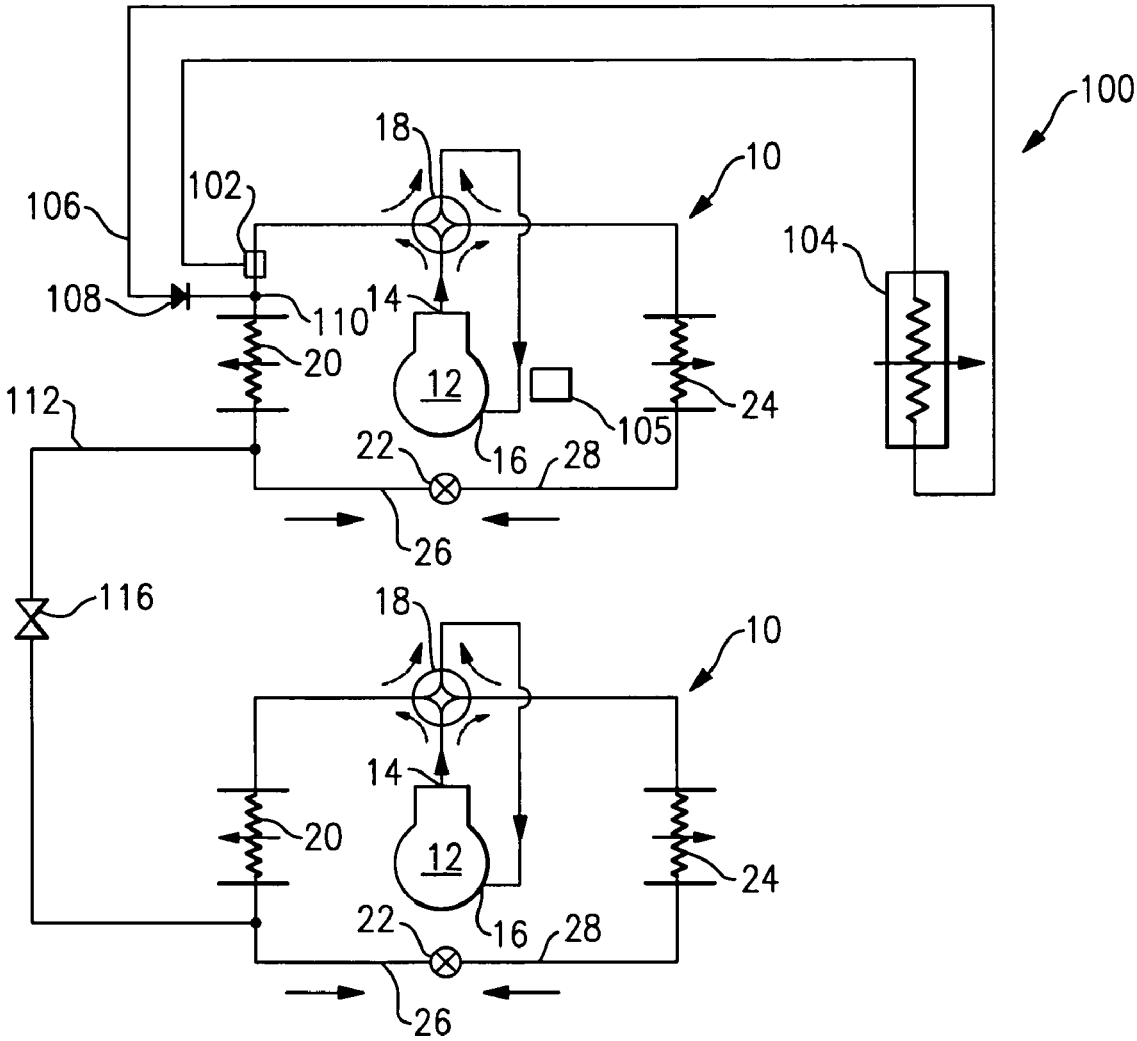
FIG. 1 shows a first embodiment.

FIG. 1 shows a multi-circuit heat pump system 100. As shown, there is a pair of circuits 10. Of course, other number of circuits would be within the scope of this invention. Each circuit 10 includes a compressor 12 delivering refrigerant to a discharge line 14. A suction line 16 returns refrigerant to the compressor 12. A four-way valve 18 selectively routes refrigerant from the line 14 to either an outdoor heat exchanger 20 in the cooling (or air conditioning) mode of operation, or to an indoor heat exchanger 24 in the heating (or heat pump) mode of operation. In the cooling mode, a four-way valve 18 routes the refrigerant to an outdoor heat exchanger 20, then to a main expansion device 22, and then to an indoor heat exchanger 24, from where it is returned through the four-way valve 18 and suction line 16 back to the compressor 12. In the heating mode, a direction of the refrigerant flow through the system is essentially reversed, and the refrigerant flows from the compressor 12, through the four-way valve 18, through the indoor heat exchanger 24, main expansion device 22, to the outdoor heat exchanger 20, and then again through the four-way valve 18 and through the suction line 16 back to the compressor 12. This general operation is as known in the art. As can be seen in the FIG. 1, the four-way valve 18 is controlled to either achieve cooling or heating mode of operation. Furthermore, as was mentioned earlier, if the expansion device cannot handle the reversing flow, then, as one of the potential solutions, a pair of unidirectional expansion devices, with the corresponding check valves, is to be employed instead. Also, as shown in the FIG. 1, at least one of the two circuits 10, is provided with a reheat function provided by a reheat coil 104. A three-way valve 102 (or any equivalent device, such as a pair of conventional valves) is operable by the control for the heat pump system 100, and selectively delivers refrigerant through the coil 104 when the reheat function is desired. As is shown, the reheat coil 104 is positioned to be in a path of air delivered by an air moving device 105, and after having this air passed over the indoor heat exchanger 24. Refrigerant having passed through the reheat coil returns through a line 106 and a check valve 108 back to the main circuit 10 at a point 110.

As is known, the reheat coil is operated when dehumidification is desired and, in many cases, when the air needs to be reheated after leaving indoor heat exchanger 24 to improve the occupant's comfort. At least a portion of that air then passes over the reheat coil 104 where its temperature rises.

The present invention provides several distinct modes of operation independently for each circuit, increasing overall system operational flexibility in satisfying external latent and sensible load demands, as would be apparent. Also, each circuit 10 can be operated while the other is shut down. The circuit 10 having the reheat branch and reheat coil 104 can be operated in multiple dehumidification modes as well (depending on the reheat branch design and configuration). Further, both circuits can be operated together, each in any of practical cooling, heating or dehumidification regimes and with or without the reheat function being provided, covering a wide spectrum of applications.

An optional connection line 112 includes a flow control device 116 and may selectively provide communication of refrigerant between the circuits 10.

Communicating lines 112 and a flow control device 116 manage refrigerant transfer between the circuits in response to the changing modes of operation and environmental conditions. As an example, if one of the two circuits has a reheat coil, utilizing for instance the discharge refrigerant vapor for the reheat function, and the other one doesn't, and both circuits operate in a cooling mode, over time some refrigerant in the first circuit will migrate to the reheat coil (since no insulation means for the reheat branch are perfect). This may cause undercharge conditions in the first circuit. To remedy the situation and to re-optimize the refrigerant charge, valve 116 is opened for a determined period of time to transfer some of the refrigerant from the second circuit to the first circuit. During this transfer, essential system parameters, such as discharge and suction pressures and temperatures, may be monitored to determine the amount of time for valve 116 to be open. Also, it should be assured that the connection point in the second circuit is at a higher pressure than in the first circuit to maintain positive pressure difference during the refrigerant transfer. This can be achieved by a number of means, including (but not limited to) execution of the head pressure control; temporary shutdown of the first circuit; or having connection points at various system locations, such as at a high and low pressure side of the system for the second and first circuits respectively. A person ordinarily skilled in the art will recognize a number of conditions at which the system 100 benefits from opening valve 116 and transferring refrigerant from one circuit to the other.

As before, an overall number of circuits as well as a number of circuits incorporating reheat coils in the multi-circuit heat pump system can be extended to more than two. Additionally, the number of interconnection points and their locations for each circuit may vary with the system design configuration and application requirements or such interconnection maybe not needed at all for some circuits or certain applications. Once again, various reheat concepts can be utilized and benefit from this invention. Also, each three-way valve can be substituted with a pair of conventional valves, if desired. Various other benefits of operating the valve 116 would be apparent to a worker ordinarily skilled in the art.

Figure 2:
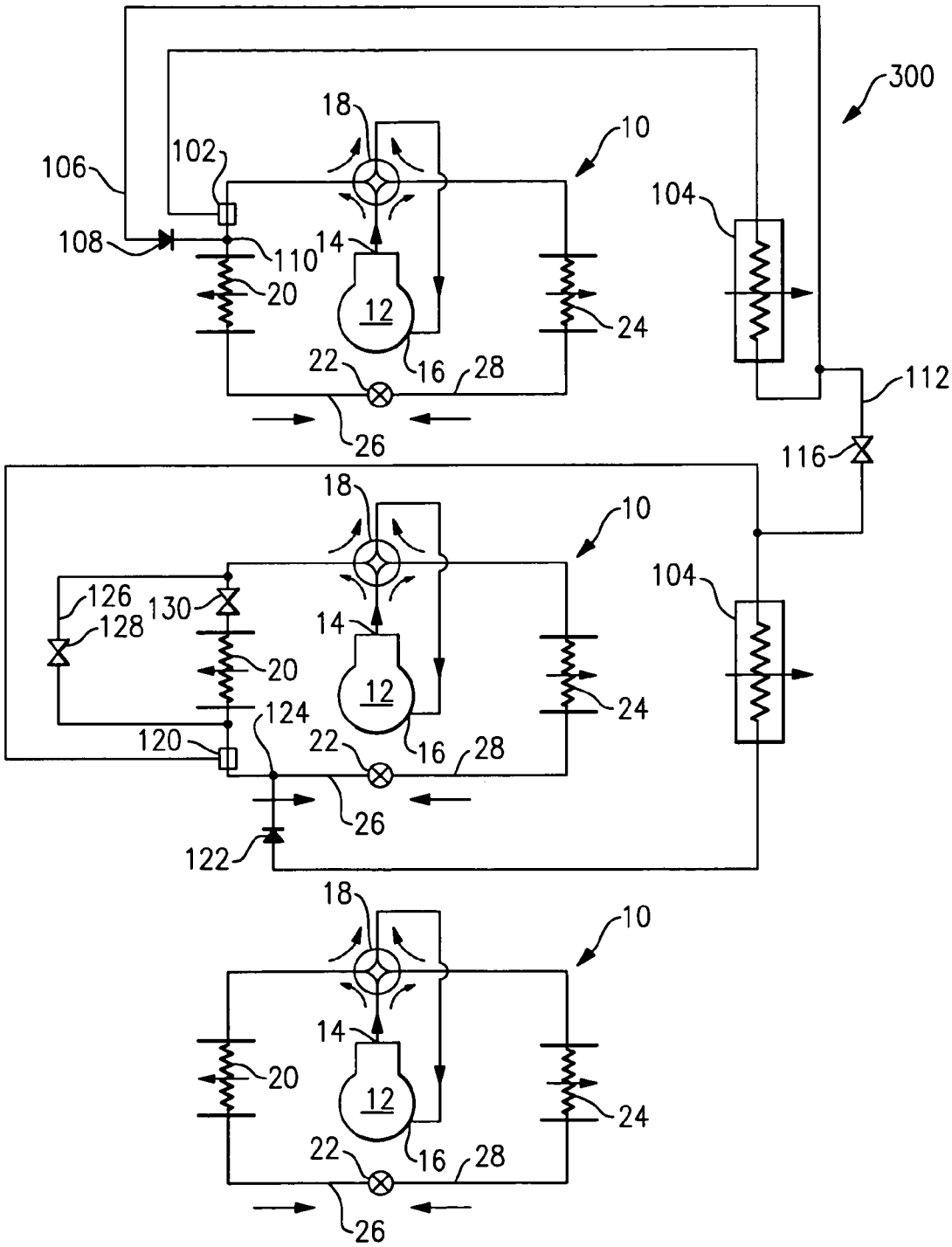
FIG. 2 shows a second embodiment.

FIG. 2 shows another embodiment 300 wherein there are three circuits 10. Two of the circuits are provided with a reheat function in this heat pump system schematic. The reheat coil 104 in one of the circuits is connected in a manner similar to that in the FIG. 1 embodiment and utilizes discharge refrigerant vapor for the reheat function (the reheat coil is arranged sequentially and is located upstream of the outdoor heat exchanger). However, another reheat coil has a three-way valve 120 between the outdoor heat exchanger 20 and expansion device 22 and may use either vapor, two-phase or liquid refrigerant for the reheat purpose in various dehumidification modes of operation (although the reheat coil is still arranged sequentially but is located downstream of the outdoor heat exchanger now). A return line returns refrigerant to the main circuit from the reheat coil 104 through a check valve 122 to a point 124.

Optional communication lines 112 and a flow control device 116 perform a function similar to that mentioned above for selectively communicating refrigerant between the two circuits 10 as well as managing and re-optimizing the refrigerant charge within the entire heat pump system. Once again, these communication means may not be necessary for some circuits or some applications and installations.

A bypass line 126 and valves 128 and 130 allow some of the refrigerant or its entire amount to be selectively bypassed around the outdoor heat exchanger 20. Refrigerant is usually bypassed around the outdoor heat exchanger 20 to achieve a variable sensible heat ratio and when the entire cooling load is not demanded but there is still a demand for dehumidification. Two flow control devices 128 and 130 manage adequate refrigerant flows through the outdoor coil 20 and around it, through the bypass line 126. These two conventional flow control devices can be replaced by a single three-way valve, if desired.

The second embodiment provides a higher degree of flexibility in system operation and control when compared to the first embodiment. First, a number of the heat pump circuits is greater. Second, two circuits have an ability to operate in dehumidification regimes, in addition to cooling and heating. Third, the reheat concepts are different for the two abovementioned circuits. Lastly, the outdoor heat exchanger bypass provides additional control options.

It should be understood that indoor and outdoor heat exchangers do not have to be separate units but can be combined instead in a single component with the independent refrigerant flow path provided for each circuit. Also, not all the circuits in the multi-circuit heat pump system have to be heat pump circuits and can be conventional cooling circuits, if desired.

A main aspect of the invention is that each circuit in the multi-circuit heat pump system may have an independent and different reheat concept, which along with optional refrigerant communication means between the circuits, provide enhanced capability in system operation and control in satisfying a wide spectrum of external sensible and latent load demands. The teachings of this invention are not limited to a specific system configuration or reheat concept, and the benefits of the invention can be easily extended to other design arrangements by a person ordinarily skilled in the art.

Providing an appropriate control for operation of all of these components and devices would also be within the skill of a worker in this art.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A heat pump system comprising:

a plurality of circuits, with each of said circuits including a compressor, an outdoor heat exchanger, an expansion device, and an indoor heat exchanger, and a first flow control device for selectively routing refrigerant from said compressor to either said indoor heat exchanger when in a heating mode, or to said outdoor heat exchanger when in a cooling mode;

at least one of said circuits having a reheat branch;

said reheat branch receiving refrigerant, and passing the refrigerant through a reheat coil, and returning the refrigerant to the circuit downstream of the reheat coil, and an air-moving device for passing air over at least a portion of said indoor heat exchanger, and over at least a portion of said reheat coil; and at least one additional flow control device being included to selectively communicate refrigerant between at least two circuits.

2. The heat pump system as set forth in claim 1, wherein at least one of said plurality of circuits does not include a reheat branch.

3. The heat pump system as set forth in claim 1, wherein a second flow control device for communicating refrigerant to said reheat coil is positioned in said circuit.

4. The heat pump system as set forth in claim 3, wherein said second flow control device is a three-way valve.

5. The heat pump system as set forth in claim 3, wherein said second flow control device selectively communicates refrigerant to said reheat coil when dehumidification of air passing over said portion of said indoor heat exchanger is desired.

6. The heat pump system as set forth in claim 1, wherein said reheat coil and said outdoor heat exchanger are positioned in a parallel arrangement within said circuit.

7. The heat pump system as set forth in claim 1, wherein said reheat coil and said outdoor heat exchanger are positioned in a sequential arrangement within said circuit.

8. The heat pump system as set forth in claim 7, wherein said reheat coil is positioned upstream of said outdoor heat exchanger.

9. The heat pump system as set forth in claim 7, wherein said reheat coil is positioned downstream of said outdoor heat exchanger.

10. The heat pump system as set forth in claim 1, wherein there are at least three of said circuits, and at least two of said circuits include reheat branches.

11. A heat pump system comprising:

a plurality of circuits, with each of said circuits including a compressor, an outdoor heat exchanger, an expansion device, and an indoor heat exchanger, and a first flow control device for selectively routing refrigerant from said compressor to either said indoor heat exchanger when in a heating mode, or to said outdoor heat exchanger when in a cooling mode;

at least one of said circuits having a reheat branch; said reheat branch receiving refrigerant, and passing the refrigerant through a reheat coil, and returning the refrigerant to the circuit downstream of the reheat coil, and an air-moving device for passing air over at least a portion of said indoor heat exchanger, and over at least a portion of said reheat coil; and at least two circuits having reheat branch configurations different from each other.

12. The heat pump system as set forth in claim 11, wherein said at least two circuits have different refrigerant tap locations for the reheat branches.

13. The heat pump system as set forth in claim 11, wherein said at least two circuits have different refrigerant return locations for the reheat branches.

14. A heat pump system comprising:

a plurality of circuits, with each of said circuits including a compressor, an outdoor heat exchanger, an expansion device, and an indoor heat exchanger, and a first flow control device for selectively routing refrigerant from said compressor to either said indoor heat exchanger when in a heating mode, or to said outdoor heat exchanger when in a cooling mode;

at least one of said circuits having a reheat branch; said reheat branch receiving refrigerant, and passing the refrigerant through a reheat coil, and returning the refrigerant to the circuit downstream of the reheat coil, and an air-moving device for passing air over at least a portion of said indoor heat exchanger, and over at least a portion of said reheat coil; and at least one circuit having bypass line to selectively bypass refrigerant around said outdoor heat exchanger.

15. The heat pump system as set forth in claim 14, wherein a flow control device selectively controls the flow of refrigerant passing through said bypass line.

16. A method of operating a multi-circuit heat pump system comprising the steps of:

(1) providing a plurality of heat pump circuits, a common control for said plurality of heat pump circuits and providing at least one of said heat pump circuits with a reheat branch;

(2) selectively operating said multiple circuits, and selectively operating said reheat branch to provide desired air temperature and humidity levels; and (3) including the step of selectively communicating refrigerant between at least two circuits.

17. The method of claim 16, further including the step of selectively bypassing refrigerant around an outdoor heat exchanger in at least one of said heat pump circuits.

18. The method of claim 16, wherein at least one of said heat pump circuits is operated in a cooling mode, and at least one of said heat pump circuits is operated with said reheat branch.

19. The method of claim 16, wherein at least one of said heat pump circuits is operated in a cooling mode and at least one of said heat pump circuits is operated in a heating mode.

20. The method of claim 16, wherein at least one of said heat pump circuits is operated in a heating mode, and at least one of said heat pump circuits is operated with said reheat branch.

21. The method of claim 16, wherein said reheat branch is selectively operated when it is desired to remove humidity from air passing into an environment to be conditioned.

* * * * *